US007182993B1

(12) United States Patent
Hamilton

(10) Patent No.: US 7,182,993 B1
(45) Date of Patent: Feb. 27, 2007

(54) TABLE CUSHIONING ASSEMBLY

(76) Inventor: Colleen M. Hamilton, 43 Witchwood Rd., South Yarmouth, MA (US) 02664

( * ) Notice: Subject to any disclaimer, the term of this patent is extended or adjusted under 35 U.S.C. 154(b) by 184 days.

(21) Appl. No.: 10/918,998

(22) Filed: Aug. 16, 2004

(51) Int. Cl.
*A47B 97/00* (2006.01)

(52) U.S. Cl. ..... 428/100; 428/99; 428/122; 248/345.1; 108/27

(58) Field of Classification Search ..... 428/99, 428/100, 122; 248/345.1; 446/227, 901, 446/490, 491; 108/27; 5/663, 946
See application file for complete search history.

(56) References Cited

U.S. PATENT DOCUMENTS

| | | | | |
|---|---|---|---|---|
| 4,153,230 | A | 5/1979 | Giacin | |
| 4,582,739 | A | 4/1986 | Givens | |
| D289,890 | S | 5/1987 | Adell | |
| 5,299,521 | A | 4/1994 | Loucks | |
| 5,639,072 | A * | 6/1997 | McCall | 267/139 |
| 5,855,412 | A * | 1/1999 | Smith et al. | 297/256.17 |
| 6,116,162 | A | 9/2000 | Santa Cruz et al. | |
| 6,378,831 | B1 | 4/2002 | Copeland, Jr. | |
| 6,682,037 | B1 * | 1/2004 | Ouellette | 248/345.1 |

* cited by examiner

*Primary Examiner*—Alexander S. Thomas

(57) ABSTRACT

A table cushioning assembly includes an elongated member that comprises a resiliently compressible material. The elongated member has a generally oval shaped cross-section taken perpendicular to a longitudinal axis of the elongated member. The elongated member has a top side, a bottom side, a forward edge and a rearward edge. The forward edge has a slot extending therein along a length of the elongated member. A covering is positioned over and encloses the elongated member. A plurality of suction cups is attached to and extends away from the covering. The suction cups are positioned in the slot. An edge of a table may be extended into the slot and the suction cups releasably attached to the table so that the elongated member extends over and along the edge of the table.

9 Claims, 6 Drawing Sheets

TABLE CUSHIONING ASSEMBLY

BACKGROUND OF THE INVENTION

1. Field of the Invention

The present invention relates to cushioning devices and more particularly pertains to a new cushioning device for protecting an infant, toddler or child from injuring themselves on the edge of a table or countertop.

2. Description of the Prior Art

The use of cushioning devices is known in the prior art. U.S. Pat. No. 4,153,230 describes a bumper system utilizing stretchable couplers for attaching a bumper along the edge of a table. A similar device is found in U.S. Design Pat. No. 289,890 that depicts a bumper assembly that may be positioned on along the edge of a car door. Yet another similar device is U.S. Pat. No. 5,299,521 that describes a bumper assembly that is positionable over the edge of a boat to protect the boat from a dock or pier. Still another device is U.S. Pat. No. 6,378,831 that allows a person to attach air-cushions along the edge of a table to protect a person from injuring themselves on the edge of the table.

While these devices fulfill their respective, particular objectives and requirements, the need remains for a device that allows a parent or guardian to protect a child from injuring themselves on a table edge with a device that is easily transportable and adaptable to any table or countertop so that the device may be taken to restaurants and other places away from the home. The device should also have the ability to hold a plurality of toys so that the device may also entertain the child.

SUMMARY OF THE INVENTION

The present invention meets the needs presented above by generally including an elongated member that comprises a resiliently compressible material. The elongated member has a generally oval shaped cross-section taken perpendicular to a longitudinal axis of the elongated member. The elongated member has a top side, a bottom side, a forward edge and a rearward edge. The forward edge has a slot extending therein along a length of the elongated member. A covering is positioned over and encloses the elongated member. A plurality of suction cups is attached to and extends away from the covering. The suction cups are positioned in the slot. An edge of a table may be extended into the slot and the suction cups releasably attached to the table so that the elongated member extends over and along the edge of the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
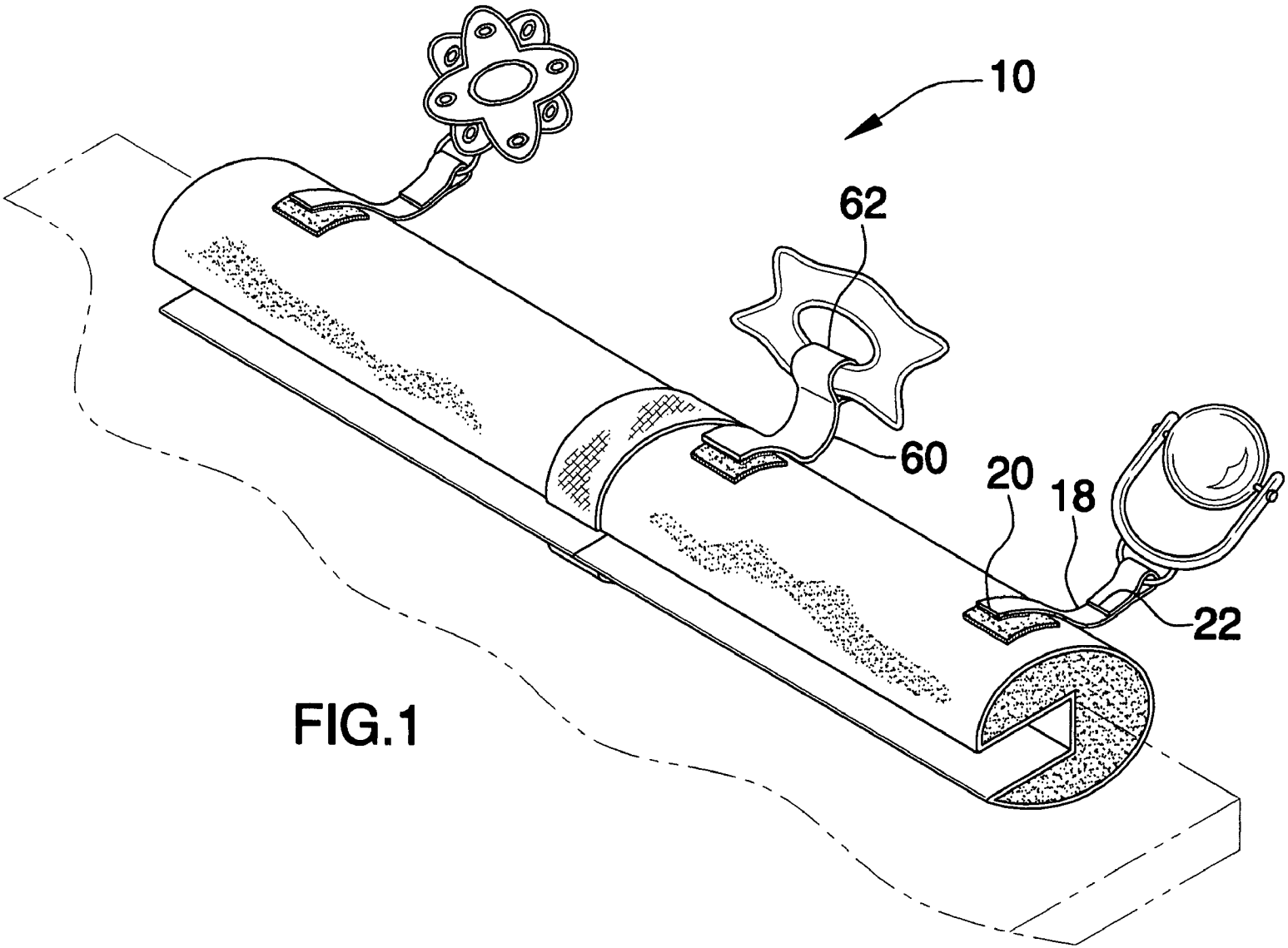
FIG. 1 is a perspective view of a table cushioning assembly according to the present invention.
Figure 2:
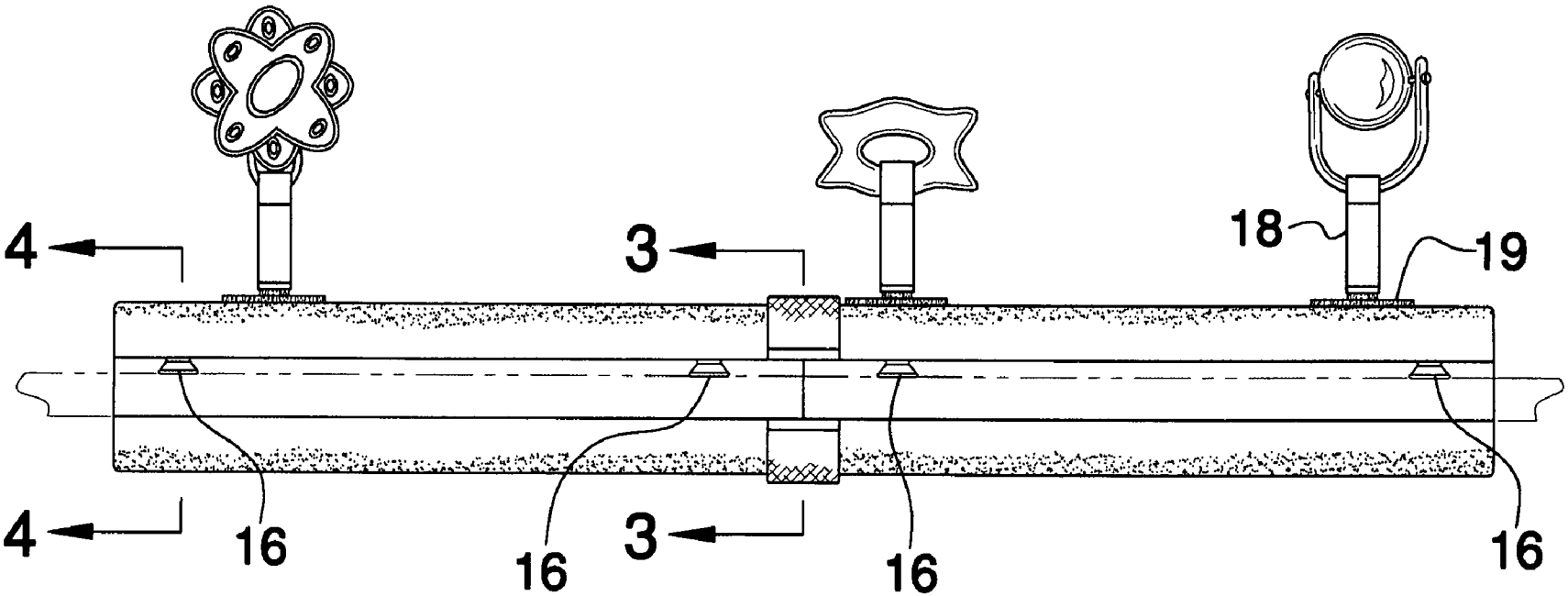
FIG. 2 is a front view of the present invention.
Figure 3:
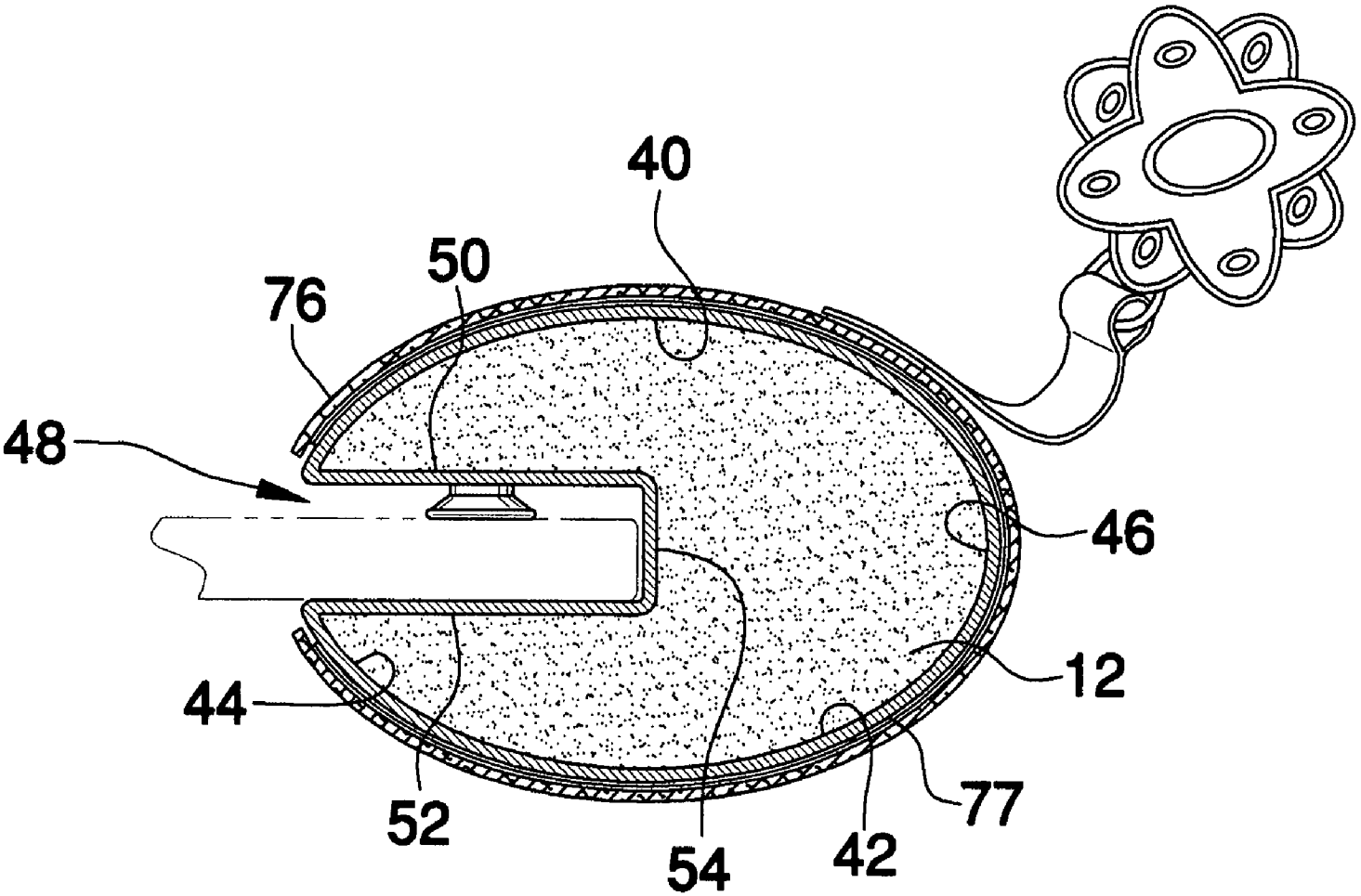
FIG. 3 is a cross-sectional view taken along line 3—3 of FIG. 2 of the present invention.
Figure 4:
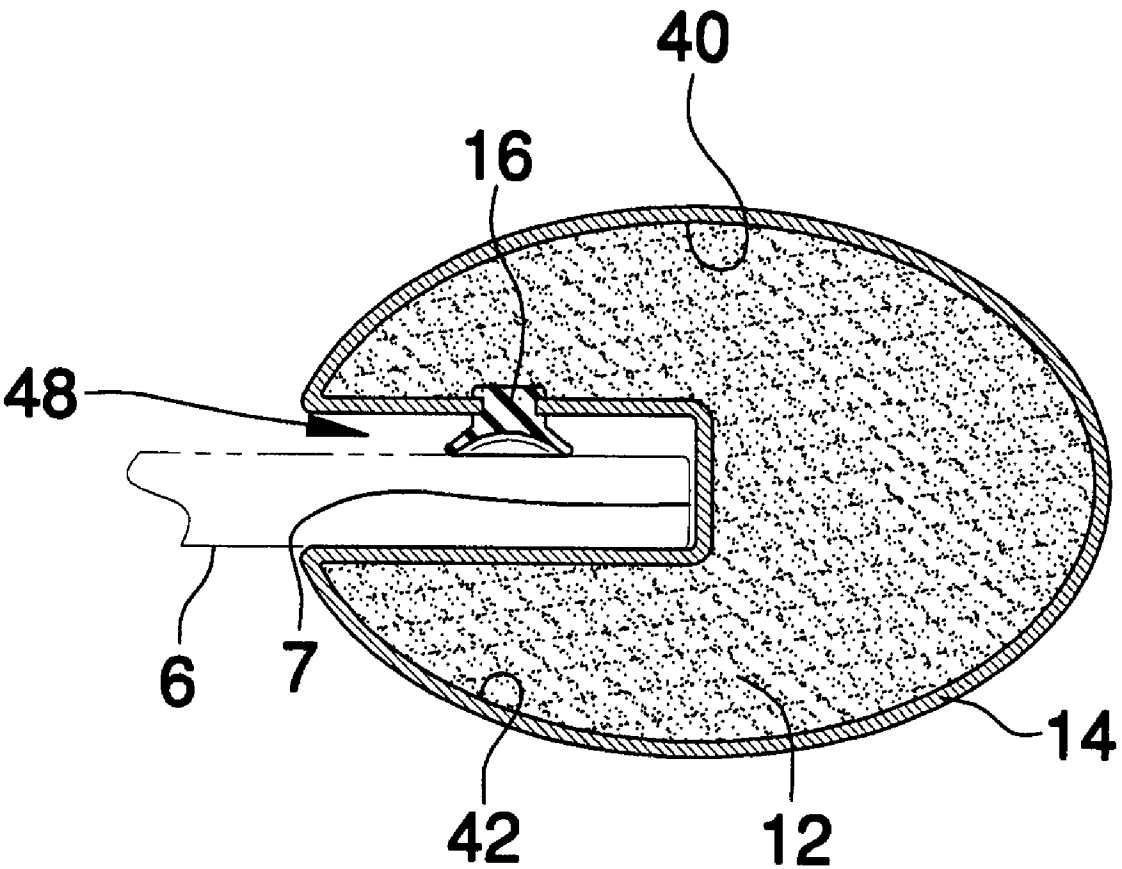
FIG. 4 is a cross-sectional view taken along line 4—4 of FIG. 2 of the present invention.
Figure 5:
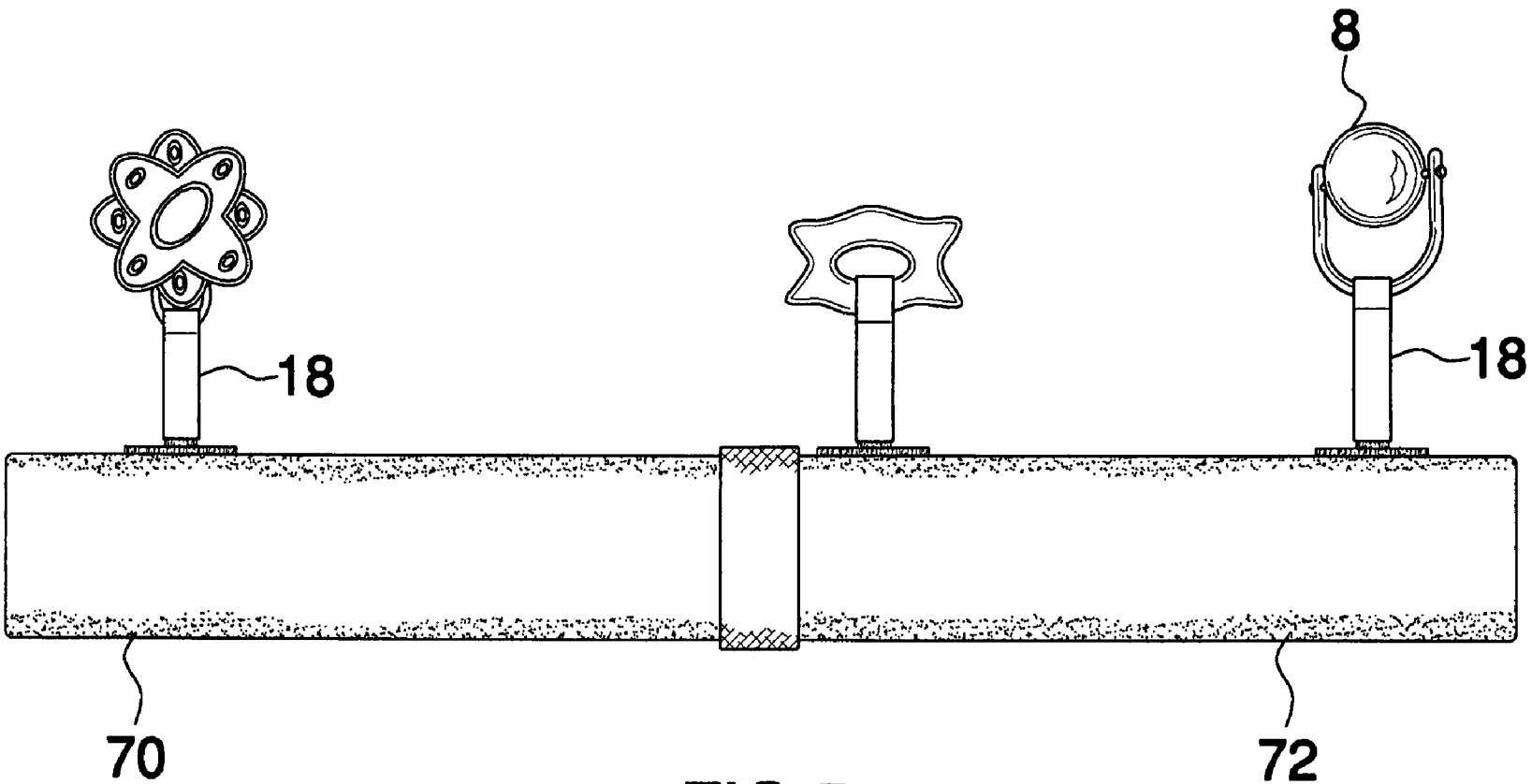
FIG. 5 is a back view of the present invention.
Figure 6:
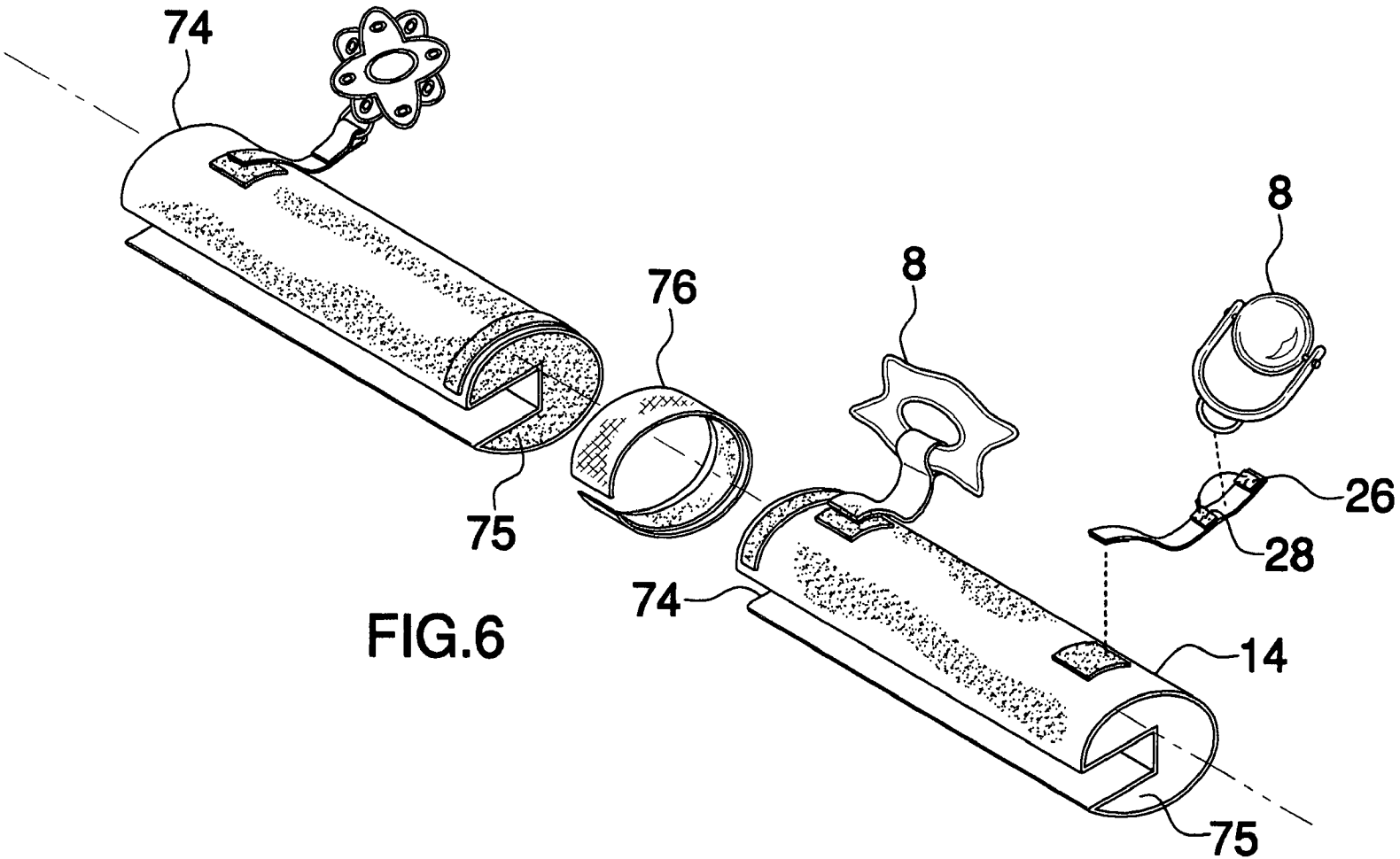
FIG. 6 is a perspective view of the present invention.

With reference now to the drawings, and in particular to FIGS. 1 through 6 thereof, a new cushioning device embodying the principles and concepts of the present invention and generally designated by the reference numeral 10 will be described.

As best illustrated in FIGS. 1 through 6, the table cushioning assembly 10 generally includes an elongated member 12 that is comprised of a resiliently compressible material. The resiliently compressible material ideally comprises a foam material that has an indention load deflection of at least 25 pounds. Examples of the material that may be used to construct the elongated member 12 include, but are not limited to, polyurethane, polyethylene, polyester, polyolefin, polyvinyl chloride, ethylene vinyl acetate, and ethylene propylene diene monomer. In some respects, polyurethane is preferred as it is generally hypoallergenic and is resistant to mold. The elongated member 12 has a length generally between 8 inches and 24 inches and preferably has an oval shaped cross-section taken perpendicular to a longitudinal axis of the elongated member 12. At the least, the elongated member 12 should have all rounded peripheral edges along the length of the elongated member 12. The elongated member includes a top side 40, a bottom side 42, a front edge 44 and a rear edge 46. A slot 48 extends into the front edge 44 and along the entire length of the elongated member 12.

A covering 14 is positioned over and encloses or encases the elongated member 12. The covering 14 comprises a cloth material that is preferably easy cleaning, such as a nylon material. Nylon is preferred as it can be written on with a crayon and the writing may be easily removed.

A plurality of suction cups 16 is attached to and extends away from the covering 14. The suction cups 16 are positioned in the slots 48. The slot 48 has a back wall 54, a top wall 50 and a bottom wall 52. The suction cups 16 are positioned on the top wall 50 and extend toward the bottom wall 52. The plurality of suction cups 16 includes at least two suction cups 16.

A plurality of strap members 18 is removably attached to the covering 14 with a hook and loop securing means 19. Each of the strap members 18 has an attached end 20 and a free end 22. Each of the strap members 18 is positioned generally adjacent to the top side 40 of the elongated member 12. The strap members 18 are spaced from each other and the plurality of strap members 18 preferably includes as least 3 strap members 18. Each of a plurality of securing members is attached to the strap members 18 for selectively securing each of the straps members 18 in a looped formation. Each of the securing members includes a first mating member 26 positioned adjacent to a respective one of the free ends 22 and a second mating member 28 positioned nearer to a respective one of the attached ends 20.

The first mating members 26 may be releasably attached to an associated one of the second mating members 28 such that a loop is defined. Each of the securing members preferably includes a hook and loop securing means. Secondary strap members 60 may have closed loops 62.

In use, an edge 7 of the table 6 is positioned in the slot 48 and each of the suction cups 16 is selectively attached to a table 6 so that the elongated member 12 extends over and along the edge 7. This positioning prevents a toddler, or infant in a high chair or booster chair, from injuring themselves should they strike their head on the edge 7. The straps 18 can be used for attaching toys 8 or teething rings to the covering 14. The toys 8, particularly those which are plush, may be attached directly to the hook and loop securing means if their exterior is comprised of a fibrous material, or a hook and loop means may be attached to their exterior in order to secure the toys to the straps 18.

As is apparent in from the figures, a pair of assemblies 70, 72 may be used each including the elements noted above. When a pair of assemblies is used, each has a first end 74 and a second end 75. When the first end 74 of a first assembly 70 is aligned with the second end 75 of a second assembly 72, the slots 48 in each are aligned. An attachment assembly releasably attaches together the first 70 and second 72 assemblies. The attachment assembly preferably includes a flexible panel 76 that may be positioned along an adjoining edge of the first 70 and second 72 assemblies. Hook and loop fasteners 77 secure the panel 76 to the coverings 14 of the assemblies 70, 72 so that the first 70 and second 72 assemblies are attached together. The use of two assemblies allows for the covering of a longer edge 7 while still proving for easy storage and transportation by releasing the first assembly 70 from the second assembly 72.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child safety cushion device being removably attachable on a table, said device comprising:

an elongated member comprising a resiliently compressible material, said elongated member having a generally oval shaped cross-section taken perpendicular to a longitudinal axis of said elongated member, said elongated member having a top side, a bottom side, a forward edge and a rearward edge, said forward edge having a slot extending therein along a length of said elongated member, said slot having a back wall, a top wall and a bottom wall;

a covering being positioned over and enclosing said elongated member;

a plurality of suction cups being attached to and extending away from said covering, said suction cups being positioned in said slot, each of said suction cups being positioned on said top wall of said slot, each of said section cups extending toward said bottom wall, said suction cups being positioned on said top wall and extending toward said bottom wall;

a plurality of strap members being releasably attached to said covering, each of said strap members having an attached end and a free end, each of said strap members being positioned generally adjacent to said top side of said elongated member, said strap members being spaced from each other, each of a plurality of securing members being attached to one said strap members for selectively securing each of said strap members in a looped formation, a plurality of toys being provided, each of said free ends having one of said toys securely attached thereto; and wherein an edge of the table may be extended into said slot and said suctions cup releasably attached to said table so that the elongated member extends over and along the edge of the table.

2. The device according to claim 1, wherein said resiliently compressible material comprising a foam material.

3. The device according to claim 2, wherein said foam material having an indention load deflection of at least 25 pounds.

4. The device according to claim 1, wherein said elongated member has a length generally between 8 inches and 24 inches.

5. The device according to claim 1, wherein said covering comprises a nylon material.

6. The device according to claim 1, wherein each of said securing members includes a first mating member positioned adjacent to a respective one of said free ends and a second mating member positioned nearer to a respective one of said attached ends, wherein said first mating members may be releasably attached to an associated one of said second mating members such that a loop is defined, each of said securing members including a hook and loop securing means.

7. The device according to claim 1, further including a pair of said devices such that a first device and a second device are defined, each of said first and second devices having a first end and a second end, said slots in said elongated members being aligned when said first end of first device is abutted against said second end of said second device, an attachment assembly being adapted for releasably securing said first and second devices in an aligned orientation.

8. A child safety cushion device being removably attachable on a table, said device comprising:

an elongated member comprising a resiliently compressible material, said resiliently compressible material comprising a foam material, said foam material having an indention load deflection of at least 25 pounds, said elongated member having a length generally between 8 inches and 24 inches, said elongated member having a generally oval shaped cross-section taken perpendicular to a longitudinal axis of said elongated member, said elongated member having a top side, a bottom side, a forward edge and a rearward edge, said forward edge having a slot extending therein along a length of said elongated member;

a covering being positioned over and enclosing said elongated member, said covering comprising a nylon material;

a plurality of suction cups being attached to and extending away from said covering, said suction cups being positioned in said slot, said slot having a back wall, a top wall and a bottom wall, each of said suction cups being positioned on said top wall and extending toward said bottom wall, said plurality of suction cups including at least two suction cups;

a plurality of strap members being releasably attached to said covering, each of said strap members having an attached end and a free end, each of said strap members being positioned generally adjacent to said top side of said elongated member, said strap members being spaced from each other;

a plurality of securing members being attached to said strap members for selectively securing each of said strap members in a looped formation, each of said securing members including a first mating member positioned adjacent to a respective one of said free ends and a second mating member positioned nearer to a respective one of said attached ends, wherein said first mating members may be releasably attached to an associated one of said second mating members such that a loop is defined, each of said securing members including a hook and loop securing means, a plurality of toys being provided, each of said free ends having one of said toys securely attached thereto; and wherein an edge of the table may be extended into said slot and said suctions cup releasably attached to said table so that the elongated member extends over and along the edge of the table.

9. The device according to claim 8, further including a pair of said devices such that a first device and a second device are defined, each of said first and second devices having a first end and a second end, said slots in said elongated members being aligned when said first end of first device is abutted against said second end of said second device, an attachment assembly being adapted for releasably securing said first and second devices in an aligned orientation.

* * * * *